United States Patent [19]

Jago et al.

[11] 4,024,007

[45] May 17, 1977

[54] LINING CAVITIES WITH HEAT INSULATING MATERIAL

[75] Inventors: Edward John Jago; Kenton Parkes Cooley, both of Cleveland, Ohio

[73] Assignee: Foseco Trading A.G., Switzerland

[22] Filed: Dec. 11, 1972

[21] Appl. No.: 314,026

Related U.S. Application Data

[63] Continuation of Ser. No. 851,052, Aug. 18, 1969, abandoned.

[52] U.S. Cl. ..... 156/212; 156/293; 162/152; 162/155; 162/217; 264/219; 264/257; 264/267; 264/314; 264/333; 264/336

[51] Int. Cl.[2] ..... B29C 1/02; B29C 17/06

[58] Field of Search ..... 264/257, 267–269, 264/313, 314, 86, 87, 91, 219; 156/293, 294, 212; 162/152, 153, 155; 249/197–202; 164/DIG. 6, 33

[56] References Cited

UNITED STATES PATENTS

| | | | |
|---|---|---|---|
| 1,921,729 | 8/1933 | Charman | 249/201 |
| 1,921,730 | 8/1933 | Charman | 249/201 |
| 3,001,571 | 9/1961 | Hatch | 162/152 |
| 3,106,756 | 10/1963 | Demaison | 249/199 |
| 3,138,507 | 6/1964 | Wiltshire | 264/314 X |
| 3,177,105 | 4/1965 | Wiltshire | 264/314 X |
| 3,231,947 | 2/1966 | Newton | 249/197 UX |
| 3,240,663 | 3/1966 | Raczek | 162/152 |
| 3,384,149 | 5/1968 | Eastwood | 249/201 |
| 3,461,191 | 8/1969 | Dale | 162/153 |
| 3,468,368 | 9/1969 | Charman, et al. | 264/87 |
| 3,477,493 | 11/1969 | Charman et al. | 264/87 |

*Primary Examiner*—Willard E. Hoag
*Attorney, Agent, or Firm*—Leydig, Voit, Osann, Mayer & Holt, Ltd.

[57] ABSTRACT

A method of lining a cavity, such as, for example, the head box for an ingot mold, comprising applying to the surface to be lined a lining of a self-supporting deformable fibre mat refractory composition and then exerting pressure on that lining so as to deform and conform it to the shape of the cavity.

7 Claims, No Drawings

LINING CAVITIES WITH HEAT INSULATING MATERIAL

This application is a continuation of application Ser. No. 851,052, filed Aug. 18, 1969, and now abandoned. The present invention relates to the lining of cavities with heat insulating material.

In many applications in the metal-treatment industries and in the building and related industries, it is necessary to line cavities with heat insulating material. For example, it is common practice to line the heads of ingot moulds or head boxes for such moulds in order to delay the setting of the head metal and therefore minimise the occurence of pipe in the cast ingot. Similarly, the feeders and risers or large castings may be so lined. In the building industry, pipe channels may be lined with a heat insulating material in order to minimise the risk of frost damage to the pipe, or to minimise heat loss from the pipe.

There are two principal methods of applying such a lining to the cavity to be lined, that of applying a mouldable composition to the walls of the cavity and allowing or causing it to set or dry in the required shape, and that of using preformed rigid lining slabs, sheets, tubes, or the like. This second method is generally preferred since preformed dry shapes are simpler, quicker and more economic to handle. However, this method suffers from the disadvantages that the slabs need sometimes to be cut to shape, that the slabs must be affixed to the surface to be lined, and that the lining of cavities having re-entrant portions is often difficult and time consuming. The use of mouldable compositions, however, is also not without severe disadvantages, especially in lining cavities having re-entrant portions or cavities of small size.

There have been proposed, mouldable preformed heat insulating linings which consist of preformed shapes, usually having a high content of refractory fibre, which are flexible and which will, on exposure to the atmosphere, harden to give a rigid lining, usually by the evaporation of a solvent for the binder used to bond the shape to coherent form; such a solvent may be, for example, water or methanol.

According to a first feature of the present invention there is provided a method of providing a lining in a cavity which comprises applying to the surface to be lined a lining material which is a self-supporting deformable fibre mat refractory composition and exerting pressure on the surface of the applied composition sufficient permanently to deform it so as to conform the composition to the contour of the surface.

The invention is of particular value where the cavity is an ingot mould head or a head box therefor.

Preferably either the outer surface of the fibre mat refractory composition or the walls of the cavity to be lined are provided with a coating of adhesive to join the lining material to the wall.

Many particular methods of effecting the required deformation to the wall shape of the cavity may be used. In particular, a deforming means may be employed quickly easily and (if desired) automatically to effect the required deformation. According further, therefore, to the invention, there is provided a method of lining a cavity with heat insulating material which comprises: introducing into the cavity a preformed flexible lining material, introducing mechanically expansible deforming means to deform said lining material to the shape of said cavity, expanding said deforming means to deform said material and withdrawing said deforming means.

A deforming means of particular value is an inflatable bladder, and according therefore to a particular feature of the present invention there is provided a method of lining a cavity with heat insulating material which comprises inserting into the cavity a preformed flexible lining material and an inflatable bladder, inflating the bladder to urge the material against the wall and to deform said lining material to the shape of the cavity to be lined and deflating and withdrawing said bladder. The cavity may be wholly or partly lined by such a method, the bladder being surrounded by or to one side of the lining material.

The lining material, if it be of a type which needs to be caused or allowed to set to a rigid condition, may be so caused or allowed to set prior to or after deflation and withdrawal of the bladder. In some cases, the lining may be preformed to the correct shape of the cavity to be lined, and then collapsed in order to allow insertion of the lining into the cavity.

By the method of the invention it is possible easily and quickly to line cavities with heat insulating material, without the necessity of ensuring that the preformed lining shapes used correspond in shape accurately to that of the cavity to be lined. It is even possible, by the use of the method according to the invention, to line a cavity of square cross section using a preformed hollow cylindrical shape of lining material. A further advantage of the method is that the lining material may be pressed onto the cavity walls uniformly. Such an advantage is automatically achieved when an inflatable bladder is used.

The method of the present invention is of particular value in lining ingot mould heads and head boxes, risers, and the like used in metal casting. Such lining materials may consist, for example of flexible fibrous mat made by dewatering an aqueous slurry comprising inorganic fibrous material, optionally some refractory filler, and a binder, by pressure or vacuum on a suitable filter screen. Alternatively the lining material may be a flexible fibrous mat made by the partial removal of the evaporatable carrier medium from a slurry comprising inorganic fibrous material, optionally some refractory filler and a binder, in an evaporatable carrier medium. The shape of the screen may, in the case of very complex designs of cavity to be lined, match the shape and dimension of that cavity, but generally only an approximately equal shape and size is required. A particularly valuable lining material may be made in this fashion from aluminium silicate fibres and colloidal silica solution as binder.

The following examples will serve to illustrate the invention:

EXAMPLE 1

A 1% dispersion of "Kaowool" aluminium silicate fibre manufactured by the Babcock and Wilcox Company was made in 30% colloidal silica sol manufactured by the Monsanto Chemical Company. The slurry produced was filtered onto a 60 mesh bronze cylindrical screen to produce a mat of 150 mm internal diameter, 150 mm long and having a wall thickness of slightly over 12 mm. Forming was accomplished using a vacuum of approximately half an atmosphere drawn on the interior of the filter screen. The cylindrical mat was removed from the screen and flattened by gentle pressure. The flattened cylinder was inserted into a cylindrical cavity of approximately 175 mm internal diameter and opened sufficiently to enable insertion of a rubber bladder so that it extended out either end of the matted fibre sleeve. Air pressure was applied to the interior of the bladder by a hand pump, causing it to expand and force the mat into close contact with the metal pipe. On deflation of the bladder, the mat remained in place.

EXAMPLE 2

A 150 mm diameter, 150 mm high, 12 mm thick cylindrical mat was prepared from Fiberfrax aluminium silicate fibre manufactured by the Carborundum Company, novalac resin and methanol. The fibre content was 1% and the resin content 5%. The wet mat was raised to 70° C for 15 minutes, at which time it was found to be dry, of good shape and flexible. Following collapsing of the cylinder, it was inserted in a 175 mm cylindrical cavity, preheated to 260° C. The cavity was part of the riser system of a large cast iron casting. The bladder was inserted and inflated causing the sleeve to be pushed against the cavity wall. The bladder was removed and the sleeve allowed to harden in place, the methanol being evaporated by the residual heat in the cavity. Other similar cavities, also constituting risers for the same large casting were lined with commercial riser sleeves. Molten cast iron at 1350° C was poured into the runner system of the casting, and the casting allowed to solidify.

After casting the riser sleeves were examined. The commercial sleeves were extensively eroded and the risers showed a quantity of pipe indicating low thermal insulation and high chill. The riser sleeve according to the invention was substantially undamaged, and the solidified riser had a fairly flat top, indicating high thermal insulation and low chill.

EXAMPLE 3

A flexible fibrous mat refractory heat insulating composition as described in Example 1 above was produced as a coherent mat having dimensions of 110 cms long, 60 cms wide and approximately 12 mm thickness.

The mat was used to line the head of a 10 ton ingot mould, which was warm from a previous ingot casting stage.

The lining of the head of the ingot mould was effected in the following way:

A mechanically expandable former having dimensions (when expanded) approximating to the cross section of the mould opening was lowered into the mould in an unexpanded condition. The mat of flexible insulating material was then introduced between the inner walls of the mould and the former in such a way that the lining approximately conformed to the inside periphery of the upper end of the ingot mould. The former was then expanded, thus pressing the fibrous refractory insulating material firmly against the preheated mould walls to which the insulating composition adhered. The former was removed and the lining allowed to harden.

In use molten steel at 1560° C was teemed into the mould until the level of the molten metal coincided with the top of the insulating lining. After solidification of the ingot metal it was observed that the lining had withstood the erosive effects of the steel and that the incidence of primary pipe was very small; an ingot yield of 90% of sound metal was obtained. The amount of metal which was cropped from the top of the ingot was 5%. These results were most satisfactory.

EXAMPLE 4

Example 3 was repeated but instead of effecting the lining from a length of wet flexible heat insulating material, two long and two short rectangular slabs were made by drying such a wet material to a dry, but still flexible state. In this case the walls of the mould were at ambient temperature and before the lining slabs were inserted between the mould walls the former, the lining material was coated with an even layer of sodium silicate adhesive. Pressure was applied to the lining composition as in Example 3, the slabs deformed and adhered fast to the mould walls and the former was removed prior to the teeming of molten steel into the mould.

The results obtained were similar to those of Example 3 in all respects.

We claim as our invention:

1. The method of lining an ingot hot top with a preformed liner comprising:
   forming a flexible mat by removing liquid from a slurry of a refractory composition including fibrous material and a suitable binder on a filter screen, removing said mat from said screen, disposing said mat around inside surfaces of said hot top and inserting an expansible deforming means within said mat and expanding said means to press said mat into conformance with the interior surfaces of said hot top, removing said expansible deforming means, leaving said mat adhered within said hot-top thereby forming a lining and allowing said lining to harden in place.

2. A method according to claim 1 wherein the outer surface of the fibre mat refractory composition is provided with a layer of adhesive.

3. A method according to claim 1 wherein the walls of the cavity to be lined are provided with a layer of adhesive.

4. A method according to claim 1 wherein the lining material is made by forming a slurry comprising an inorganic fibrous material, a binder and an evaporatable carrier medium, and partially removing the evaporatable carrier medium to form a flexible fibrous mat.

5. The method of claim 14 wherein the slurry contains a refractory filler.

6. A method according to claim 4 wherein the carrier medium of the slurry is a member selected from the group consisting of ethanol, methanol, propanol, isopropanol and butanol.

7. The method of claim 6 wherein the slurry contains a refractory filler.

* * * * *